US005393053A

United States Patent [19]

Wiese et al.

[11] Patent Number: 5,393,053

[45] Date of Patent: Feb. 28, 1995

[54] GOLF PUTTING GREEN BALL EJECTOR

[76] Inventors: Douglas R. Wiese, 2036 Manion Dr., Warrenton, Oreg. 97146; Peter A. Norris, 7634 SW. Kelly St., Portland, Oreg. 97219

[21] Appl. No.: 230,501

[22] Filed: Apr. 20, 1994

[51] Int. Cl.[6] ..... A63B 57/00; A63B 69/36

[52] U.S. Cl. ..... 273/34 A

[58] Field of Search ..... 273/34 A, 179 R, 179 B

[56] References Cited

U.S. PATENT DOCUMENTS

| | | | |
|---|---|---|---|
| 1,402,026 | 1/1922 | Waddell | 273/34 A |
| 1,599,734 | 9/1926 | Wilson | 273/34 A |
| 1,673,852 | 6/1928 | Underwood et al. | 273/34 A |
| 1,826,641 | 10/1931 | Waddell | 273/34 A |
| 1,829,283 | 10/1931 | Kip | 273/34 A |
| 1,885,907 | 11/1932 | Garlutzo | 221/254 |
| 3,790,166 | 2/1974 | Hamilton et al. | 273/34 A |

*Primary Examiner*—George J. Marlo
*Attorney, Agent, or Firm*—Kolisch, Hartwell, Dickinson, McCormack & Heuser

[57] ABSTRACT

A golf ball ejector is disclosed in which an ejector is mounted on a pin adjacent an end of the pin for movement between lowered and raised positions on the pin. An actuator is mounted on the pin and a connection is provided between the ejector and the actuator to move the ejector relative to the pin from lowered to raised positions with the application of a downward force on the pin. The golf ball ejector is vertically inserted into a pre-formed putting green cup, and a golf ball is placed into the cup. The movement produced by pressing down on the pin ejects the golf ball from the cup.

21 Claims, 2 Drawing Sheets

GOLF PUTTING GREEN BALL EJECTOR

FIELD OF THE INVENTION

The present invention relates generally to ejectors for ejecting golf balls from golf putting green cups. More particularly, the invention relates to a golf ball ejector in which an ejector, an actuator and a putting green pin are interconnected so that actuating the actuator when the pin and a golf ball are in the cup ejects the golf ball from the cup.

BACKGROUND ART

Golf putting greens take many shapes and forms. Variations in terrain and locations of the cup within the green create various challenges for the golfer trying to hit a golf ball into the cup. Thus, putting is an important and challenging aspect of the game of golf, and can even be the sole focus of some golfers. Accordingly, it is common for golfers, either in practice or in competition, to hit numerous golf balls into one or more cups. The resulting action of bending over and removing the ball from the cup can be both tiring and time consuming. This is a particular problem on practice putting greens, in which numerous cups are located for repetitive putting.

A golf ball ejector is a device that ejects golf balls from putting green cups once the golf balls have been hit into the cup. Such a device is desirable because it minimizes the need to bend over and pick up a golf ball once it has been hit into the cup. Traditionally, this goal is accomplished by attaching a plate to the end of a standard putting green pin so that lifting the plate lifts any balls in the cup. An example of such a ball lifter is shown in U.S. Pat. No. 1,599,734. Alternatively, an ejection mechanism can be formed as part of the cup to eject the balls from the cup. An example of such an ejector is shown in U.S. Pat. No. 1,402,026. The ejector shown in U.S. Pat. No. 1,402,026 requires the installation of a special cup, and the entire cup must be removed from the earth in order to repair or replace the ejector. In addition, the ejector is operated with a gearing mechanism that must extend as far downward into the earth as the ejector is driven upward from the bottom of the cup. Thus the ejector requires an abnormally deep hole in the earth.

SUMMARY OF THE INVENTION

The invented golf ball ejector is designed for insertion into standard, preformed putting green cups, allowing interchangeability of the ejector with traditional golf putting green pins. In addition, the golf ball ejector of the present invention is removable, allowing easy maintenance and replacement of the golf ball ejector. The ejector is mounted on a pin that is inserted vertically into the cup. When the pin is inserted into the cup, the ejector is located inside the cup, and is movable to eject any golf balls that may fall into the cup. The movement of the ejector is actuated by an actuator that is connected to the pin so that balls can be ejected from the cup by pressing down on the pin.

It is an object of the invention to eject golf balls from standard pre-formed cups.

It is a further object of the invention to eject balls from a cup with a simple actuator.

Yet another object of the invention is to eject balls from a cup with a golf ball ejector that is removable from the cup.

Yet another object of the invention is to eject balls from a cup by applying a downward force on the pin placed in the cup.

DETAILED DESCRIPTION OF THE PREFERRED EMBODIMENT

Figure 1:
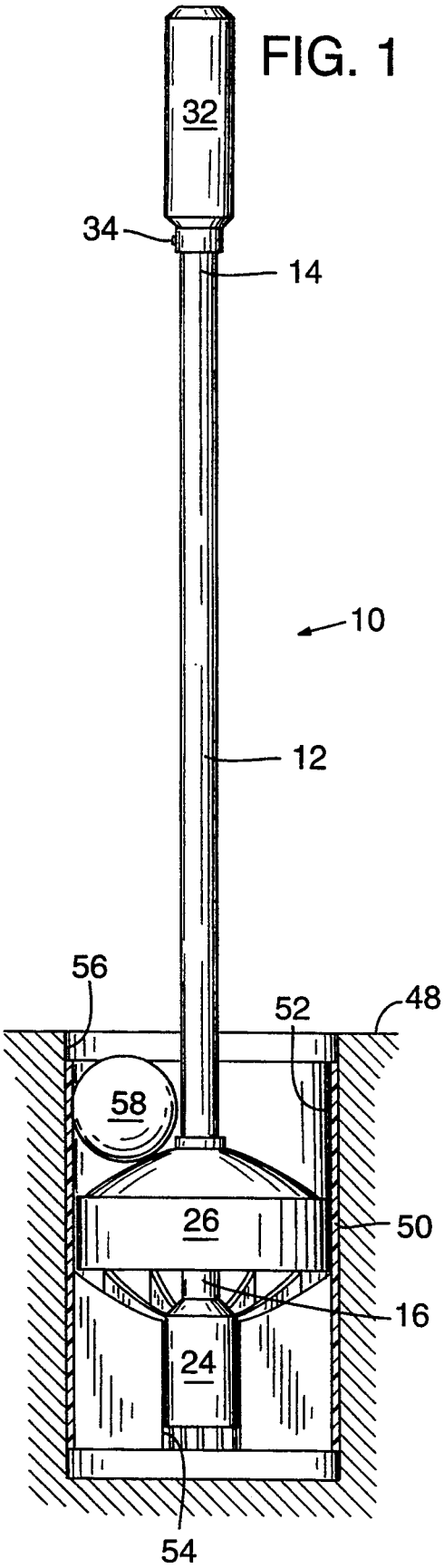
FIG. 1 is a side elevation of the ball ejector of the present invention with the actuator relaxed, shown in the environment of a cross-sectioned golf putting green cup with a golf ball resting in the cup.
Figure 2:
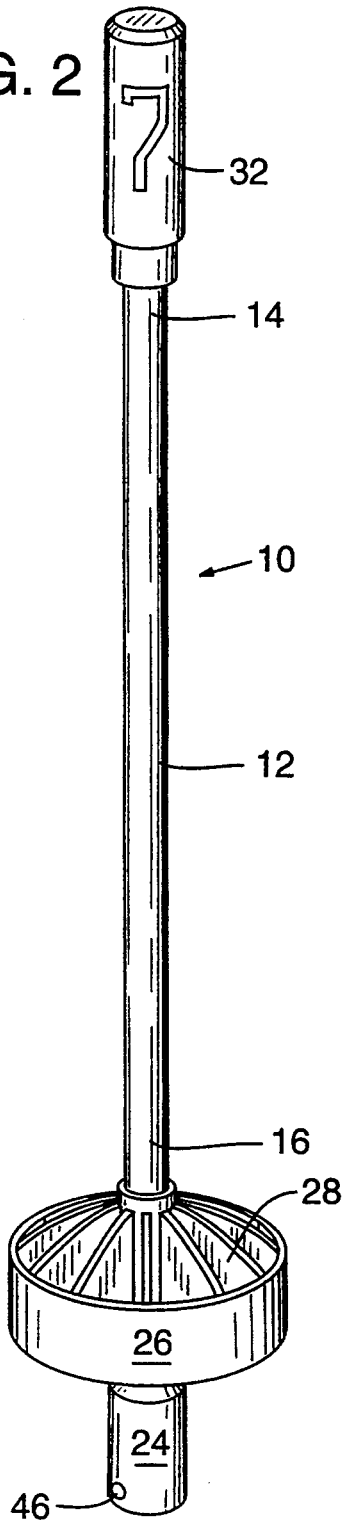
FIG. 2 is an isometric view of the ejector of the present invention shown removed from the putting green cup.
Figure 3:
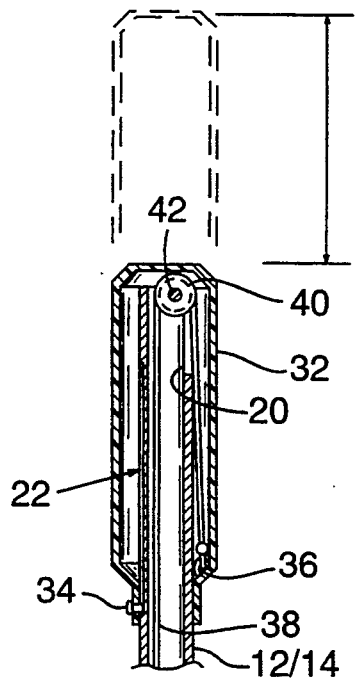
FIG. 3 is a cross-sectional side elevation of the actuator portion of the ball ejector shown in FIG. 1, shown with the actuator depressed or actuated.
Figure 4:
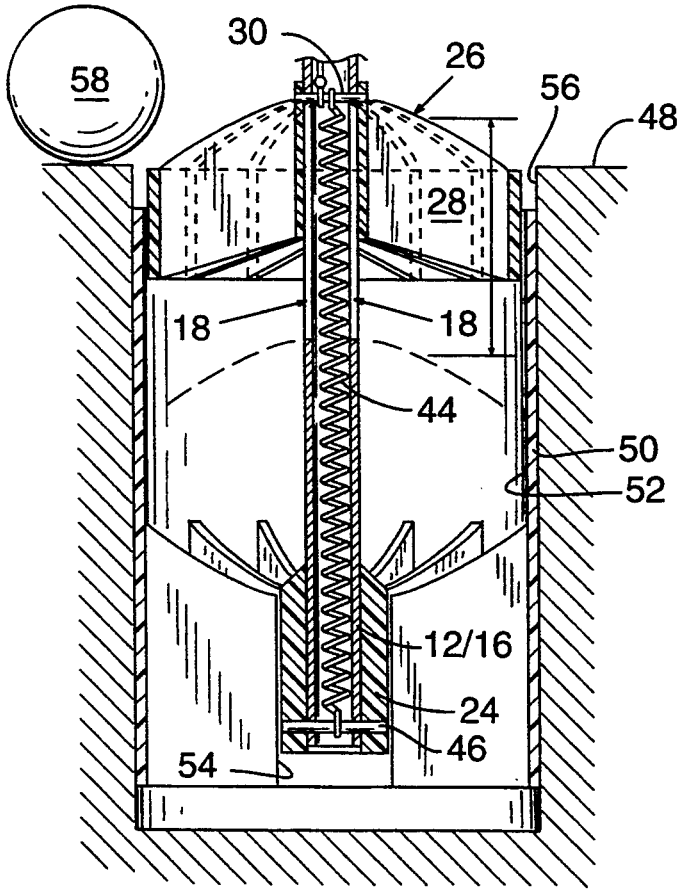
FIG. 4 is a cross-sectional side elevation of the ejector portion of the ball ejector shown in FIG. 1, shown with the ejector raised or actuated.

Referring to the drawings, the preferred embodiment of the golf ball ejector of the present invention is shown generally at 10. Ball ejector 10 includes an elongate pin 12 having distal ends. During normal operation pin 12 is vertical, and thus has a top 14 and a bottom 16. Pin 12 is preferably made from a hollow tube. A first opening 18 is formed near bottom 16 and is preferably elongate in shape. In the preferred embodiment, first opening 18 includes plural opposing elongate openings. A second opening 20 is preferably formed near top 14 and is preferably elongate in shape. In the preferred embodiment, second opening 20 extends through the end of top 14, and is thus notch-like in shape. A groove 22 is formed near top 14 and is also preferably elongate in shape. In the preferred embodiment, groove 22 does not extend through the wall of pin 12, but rather is only cut partway into the wall. In alternative embodiments, groove 22 does extend through the wall and thus resembles the elongate opening of one embodiment of first opening 18. A cylindrically-shaped plug 24 is preferably attached to bottom 16 of pin 12.

A golf ball ejector mechanism is mounted on pin 12, with the preferred embodiment being mounted as follows. A reciprocating ejector 26 is slidably mounted on pin 12 near bottom 16. An example of ejector 26 is a plunger with an outwardly sloped top, so that round objects will tend to roll away from pin 12. Alternatively, hinged or levered ejectors can be used. Ejector 26 can be solid, hollow, or, in the preferred embodiment, a plunger formed with structural fins 28. Ejector 26 is attached to pin 12, preferably with an ejector dowel 30 that extends through first opening 18. An ejector stop limits the movement of ejector 26 relative to pin 12 so that ejector 26 is slidably mounted on pin 12, but attached to pin 12 by the stop. Thus, lifting pin 12 also lifts ejector 26. In the preferred embodiment, the bottom of first opening 18 forms the ejector stop.

Ejector 26 is actuated by an actuator, preferably a handle 32 slidably mounted adjacent top 14 of pin 12. Handle 32 is attached to pin 12 by a retainer, preferably a retaining dowel 34 that extends into groove 22. An example of such a dowel is a screw. In alternative embodiments, the retainer can be in the form of a protrusion extending outwardly from pin 12 and cooperating with an indentation in handle 32. Retainer 34 forms an actuator stop that limits the movement of actuator 32 relative to pin 12. Thus, handle 32 provides a handle by which pin 12 can be lifted. An attachment point 36 is formed in handle 32, and can be in numerous forms, including a screw, pin, dowel, hole, or, preferably, a loop as shown. In the preferred embodiment, handle 32 is hollow as shown. In alternative embodiments, not shown, handle 32 is solid with a pin-receiving hole drilled into it for insertion over top 14 of pin 12. In these alternative embodiments, a groove is formed along the pin-receiving hole.

A connector 38 operatively connects the actuator to ejector 26, and is preferably a cable extending from attachment point 36 through pin 12 to ejector dowel 30. Thus, cable 38 connects point 36 to ejector 26 so that the actuator moves ejector 26 from lowered to raised positions of ejector 26 relative to pin 12 with the application of a downward force on pin 12 through handle 32. Examples of cable 38 include twine, wire, or, preferably, monofilament fishing line. A pivot 40 is formed in or attached to pin 12 at a vertical position above attachment point 36, and cable 38 passes over pivot 40 so that depressing handle 32 pulls cable 38 upwardly in pin 12 thus raising ejector 26. In the preferred embodiment, pivot 40 is a pulley rotatably mounted on a pulley dowel 42, and aligned with second opening 20. Thus cable 38 rolls over pulley 40, and second opening 20 provides a passageway so that cable 38 is not abraded or resisted by pin 12. In the alternative embodiments in which handle 32 is solid with a pin-receiving hole drilled into it, cable 38 lies in the groove formed in handle 32 along the pin-receiving hole. Thus cable 38 does not interfere with the sliding of handle 32 on pin 12.

A spring 44 is operatively connected to ejector 26 and pin 12. Spring 44 opposes the actuator to return ejector 26 to an unactuated position when the actuator is unactuated. Spring 44 is preferably placed between ejector 26 and pin 12 to force ejector 26 into its lowest position relative to pin 12. While this could be accomplished by a spring in compression pushing on ejector 26, in the preferred embodiment spring 44 is in tension pulling on ejector 26. Any suitable means can be used to attach spring 44 to pin 12, including hooking spring 44 over the end of pin 12. In the preferred embodiment, spring 44 is attached to an anchor dowel 46 that extends through plug 24.

Ball ejector 10 is designed for use in practice putting greens. Such a putting green is indicated generally at 48, and includes a cup 50. It is common for such cups to be formed by cutting a hole into the earth, and then inserting into the hole a cup-defining insert 52 having a preformed pin-receiving cylinder 54. Thus, plug 24 of ejector 10 is sized to cooperate with pin-receiving cylinder 54 so that pin 12 is sized to fit cup 50. Pin 12 is vertically supported by vertically inserting plug 24 into cylinder 54. Furthermore, ejector 26 is sized to fit into and cooperate with the cup-defining portion of insert 52 so that objects of about the size of a golf ball placed into cup 50 can be lifted by ejector 26 without falling between ejector 26 and insert 52. The top of insert 52 is normally just below the surface of green 48 so that cup 50 has a lip 56 of exposed earth.

A golf ball is shown at 58.

From the foregoing it will be seen that the preferred embodiment of the invention is a ball ejector 10 for use in a pre-formed putting green cup 50. Ball ejector 10 ejects golf balls from cup 50 with a movable ejector 26 that is slidably mounted on a pin 12 for movement between lowered and raised positions relative to pin 12. Ejector 26 is actuated with an actuator in the form of a handle 32 connected to ejector 26 by a cable 38 that rolls over a pulley 44. Thus, by depressing handle 32, ejector 26 is lifted and any balls resting in cup 50 are ejected from the cup.

Alternatively, the present invention can be viewed as a method of ejecting a golf ball 58 from a putting green cup 50. The method includes the steps of providing a pin 12 sized for vertical insertion into cup 50, as shown in FIG. 1, and mounting an ejector 26 and an actuator 32 on pin 12. Actuator 32 is operatively connected to ejector 26 so that pressing down on actuator 32 raises ejector 26. Pin 12 and ejector 26 are then placed into cup 50 with the ejector resting below lip 56 of cup 50, and a ball is placed into cup 50. Ball 58 is ejected by pressing down on actuator 32 to lift ejector 26 and eject ball 58.

INDUSTRIAL APPLICABILITY

The invented golf ball ejector is applicable in any situation where an ejector mechanism is to be added to a cup. It is particularly applicable to pre-formed cups found in practice putting greens.

While a preferred embodiment of the invented golf ball ejector has been disclosed, changes and modifications can be made without departing from the spirit of the invention.

We claim:

1. A golf ball ejector for use in a golf putting green cup comprising:

an elongate pin sized to fit vertically into the putting green cup;

an ejector mounted on the pin;

an actuator mounted on the pin;

a connector operatively connecting the actuator to the ejector; and a stop operatively connected to the pin to limit movement of the ejector relative to the pin so that lifting the pin also lifts the ejector;

wherein actuating the actuator ejects any balls that are resting on the ejector and in the cup.

2. The golf ball ejector of claim 1, further comprising a spring operatively connected to the ejector and the pin and opposing the actuator to return the ejector to an unactuated position when the actuator is unactuated.

3. The golf ball ejector of claim 1, wherein the operative connection between the actuator and the ejector comprises a cable.

4. The golf ball ejector of claim 3, further comprising a pulley over which the cable rolls.

5. The golf ball ejector of claim 1, wherein the actuator is mounted adjacent the top of the pin.

6. The golf ball ejector of claim 5, wherein the actuator provides a handle by which the pin can be lifted.

7. The golf ball ejector of claim 5, wherein the actuator comprises a handle slidably mounted on the pin.

8. The golf ball ejector of claim 7, wherein the operative connection between the actuator and the ejector comprises a cable rolling over a pulley.

9. The combination of claim 1, wherein the ejector is a plunger with an outwardly sloped top.

10. In combination with a pin sized to fit a putting green cup, a golf ball ejector mechanism comprising:

an ejector mounted on the pin and sized to fit into the putting green cup;

an actuator mounted on the pin;

a connector operatively connecting the ejector to the actuator so that actuating the actuator causes the ejector to move relative to the pin, thereby ejecting any balls that have fallen into the putting green cup and on top of the ejector; and a stop operatively connected to the pin to limit movement of the ejector relative to the pin so that lifting the pin also lifts the ejector.

11. The golf ball ejector of claim 10, further comprising a spring operatively connected to the ejector and the pin and opposing the actuator to return the ejector to an unactuated position when the actuator is unactuated.

12. The golf ball ejector of claim 10, wherein the operative connection between the actuator and the ejector comprises a cable.

13. The golf ball ejector of claim 10, wherein the actuator is mounted adjacent the top of the pin.

14. The golf ball ejector of claim 13, wherein the actuator comprises a handle slidably mounted on the pin.

15. The combination of claim 10, wherein the ejector is a plunger with an outwardly sloped top.

16. A method of ejecting a golf ball from a putting green cup comprising:

providing an elongate pin sized for vertical insertion into the cup;

mounting an ejector on the pin so that lifting the pin lifts the ejector;

mounting an actuator on the pin;

operatively connecting the actuator to the ejector so that pressing down on the actuator raises the ejector;

placing the pin and ejector into the cup with the ejector resting below the lip of the cup;

placing the ball to be ejected into the cup; and pressing down on the actuator to lift the ejector and eject the ball.

17. In combination with a golf ball and a putting green cup having a lip, a ball ejector comprising:

a pin inserted vertically into the cup;

an ejector movably mounted on the pin and inserted into the cup below the lip so that a golf ball placed into the cup rests on the ejector;

an ejector stop operatively connected to the pin to limit the movement of the ejector relative to the pin so that lifting the pin removes the ejector from the cup;

an actuator mounted on the pin;

an actuator stop operatively connected to the pin to limit the movement of the actuator relative to the pin so that lifting the actuator lifts the pin; and a connector operatively connecting the actuator to the ejector so that pressing down on the actuator moves the ejector.

18. The combination of claim 17, wherein the connector comprises:

an attachment point formed in the actuator;

a pulley rotatably connected to the pin at a vertical position above the attachment point; and a cable connecting the attachment point to the ejector and passing over the pulley.

19. The combination of claim 17, further comprising a spring placed between the pin and the ejector plate, wherein the spring forces the ejector into its lowest position relative to the pin.

20. The combination of claim 17, wherein the ejector is sloped outwardly.

21. A pin and golf ball ejector assembly comprising:

a pin;

an ejector mounted on the pin adjacent an end of the pin for movement between lowered and raised positions on the pin;

an actuator mounted on the pin for moving the ejector relative to the pin; and a connection between the ejector and the actuator producing movement of the ejector from lowered to raised positions of the ejector with the application of a downward force on the pin.

* * * * *